US010226392B2

(12) United States Patent
Chiang

(10) Patent No.: US 10,226,392 B2
(45) Date of Patent: Mar. 12, 2019

(54) ELECTRIC WHEELCHAIR FRAME

(71) Applicant: Foo You Technology Co., Ltd., Taichung (TW)

(72) Inventor: Ming-Hsiang Chiang, Taichung (TW)

(73) Assignee: Foo You Technology Co., Ltd., Taichung (TW)

( * ) Notice: Subject to any disclaimer, the term of this patent is extended or adjusted under 35 U.S.C. 154(b) by 67 days.

(21) Appl. No.: 15/625,167

(22) Filed: Jun. 16, 2017

(65) Prior Publication Data

US 2017/0367912 A1 Dec. 28, 2017

(30) Foreign Application Priority Data

Jun. 22, 2016 (TW) ..... 105119635 A

(51) Int. Cl.
*A61G 5/04* (2013.01)
*A61G 5/10* (2006.01)

(52) U.S. Cl.
CPC ..... *A61G 5/1078* (2016.11); *A61G 5/043* (2013.01)

(58) Field of Classification Search
CPC .... A61G 5/1078; A61G 5/1089; A61G 5/043; A61G 5/06
See application file for complete search history.

(56) References Cited

U.S. PATENT DOCUMENTS 4,245,847 A * 1/1981 Knott ..... A61G 5/06 280/47.16
7,293,801 B2 * 11/2007 Bertrand ..... A61G 5/043 280/755
7,828,310 B2 * 11/2010 Vreeswijk ..... A61G 5/043 180/22
8,210,556 B2 * 7/2012 Zhou ..... A61G 5/043 180/209
9,808,383 B2 * 11/2017 Mulhern ..... A61G 5/04
9,913,768 B2 * 3/2018 Cuson ..... A61G 5/06
2005/0034903 A1 * 2/2005 Wu ..... A61G 5/042 180/65.1
2005/0206149 A1 * 9/2005 Mulhern ..... A61G 5/043 280/755
2007/0209848 A1 * 9/2007 Tang ..... A61G 5/043 180/65.1
2009/0145677 A1 * 6/2009 Zhou ..... A61G 5/043 180/65.1

(Continued)

FOREIGN PATENT DOCUMENTS

TW M409966 U 8/2011

*Primary Examiner* — Drew J Brown
(74) *Attorney, Agent, or Firm* — Alan D. Kamrath; Kamrath IP Lawfirm, P.A.

(57) ABSTRACT

An electric wheelchair frame includes a frame and a power support swayably connected to a frame. A connecting rod is swayably connected to the frame, is pivotably connected to the power support, and is movable relative to the power support in a longitudinal direction. A driving device includes a connecting seat and a power output unit. The connecting seat is pivotably mounted to the power support. The power output unit is fixed to the connecting seat and includes a driving shaft extending away from the frame and a driving wheel. When the driving wheel is moving on a bumpy road, the pivotal movement between the connecting seat and the power support increases the sitting comfort of a user in an electric wheelchair.

11 Claims, 9 Drawing Sheets

(56) References Cited

U.S. PATENT DOCUMENTS

| | | | | |
|---|---|---|---|---|
| 2010/0084209 | A1* | 4/2010 | Bekoscke | A61G 5/043 180/209 |
| 2011/0012316 | A1* | 1/2011 | Cheng | A61G 5/043 280/5.514 |
| 2012/0012416 | A1* | 1/2012 | Mirzaie | A61G 5/043 180/291 |

* cited by examiner

ELECTRIC WHEELCHAIR FRAME

BACKGROUND OF THE INVENTION

The present invention relates to an electric wheelchair frame and, more particularly, to an electric wheelchair frame for increasing stability and comfort.

Taiwan Utility Patent No. M409966 entitled "LINKAGE TYPE VEHICLE FRAME" discloses a vehicle frame including a frame and two wheel assemblies mounted to two sides of the frame. Each wheel assembly includes a power support having a rod and a power source. The rod includes a first end and a second end. A through-hole is provided between the first end and the second end of the rod. A power source and a driving wheel are mounted to the first end of the rod. A first guiding wheel is mounted to the second end of the rod. Each wheel assembly further includes a connecting rod having a first end and a second end. The first end of the connecting rod includes a fork-shaped structure delimiting a groove and two elongated slots on two sides of the groove. A fixing member extends through the elongated slots. Each elongated slot includes a first end and a second end. The rod of the power support is received in the groove. The fixing member extends through the first through-hole. A second guiding wheel is mounted to the second end of the connecting rod.

Although the first and second guiding wheels of the linkage type vehicle frame can sway relative to the frame to provide a buffering effect, when the driving wheels are moving on a bumpy road surface, a considerable proportion of the vibrations and impact forces is transmitted to the frame and, thus, causes large vibrations of the frame, leading to discomfort to the user sitting in the vehicle. Furthermore, when running on a steep slope, the first guiding wheels are apt to be excessively lifted and cause deviation of the center of gravity of the frame, resulting in the risks of turning over of the linkage type vehicle frame. Furthermore, the power supports and the connecting rods might sway sideways and, thus, result in swaying of the frame and poor stability.

Thus, a need exists for a novel electric wheelchair frame to mitigate and/or obviate the above disadvantages.

BRIEF SUMMARY OF THE INVENTION

An electric wheelchair frame according to the present invention includes a frame including a side having a first fixing portion and a second fixing portion spaced from the first fixing portion in a longitudinal direction. A wheel assembly is mounted to the side of the frame and includes a power support, a first guiding wheel, a connecting rod, and a second guiding wheel. The power support is connected to the first fixing portion and is swayable relative to the frame. The first guiding wheel is rotatably mounted to an end of the power support remote to the frame. The connecting rod is connected to the second fixing portion and is swayable relative to the frame. The connecting rod is connected to the power support, is pivotable relative to the power support, and is movable relative to the power support in the longitudinal direction. The second guiding wheel is rotatably mounted to an end of the connecting rod remote to the power support. A driving device includes a connecting seat and a power output unit. The connecting seat is pivotably mounted to the power support. The power output unit is fixed to the connecting seat and includes a driving shaft and a driving wheel. The driving shaft extends away from the frame. The driving wheel is coupled to an end of the driving shaft opposite to the frame and is configured to be driven by the power output unit to rotate relative to the frame.

In an example, the connecting seat includes a first side and a second side opposite to the first side. An end of the first side of the connecting seat is pivotably mounted to the power support about a pivotal axis. The power output unit is fixed to the second side of the connecting seat. A rotating axis of the driving shaft is parallel to the pivotal axis of the connecting seat pivotably connected to the power support.

In an example, the power support includes a rod portion and an engaging portion coupled to the rod portion. The connecting seat is pivotably mounted to the engaging portion of the power support. The driving device further includes a buffering module: An end of the buffering module of the driving device is connected to the rod portion of the power support. The other end of the buffering module of the driving device is connected to an end the connecting seat opposite to a pivotal connection between the connecting seat and the power support.

In an example, two stabilizing rollers are pivotably mounted to a side of the engaging portion about two pivotal axes, respectively. The two pivotal axes of the two stabilizing rollers are parallel to each other. Two restraining plates are formed between the first side of the connecting seat. The two restraining plates abut two opposite outer sides respectively of the two stabilizing rollers.

In an example, the engaging portion is mounted between two ends of the rod portion and is located at a bottom side of the rod portion. The power support is connected to the first fixing portion by an end of the engaging portion remote to the connecting portion. The first guiding wheel is mounted to an end of the rod portion remote to the frame. The connecting rod includes a first rod and a second rod. The connecting rod is connected to the second fixing portion at a location between two ends of the first rod. One of the two ends of the first rod is pivotably connected to the rod portion and is movable relative to the rod portion in the longitudinal direction. The second rod is pivotably connected between the two ends of the first rod at a pivotal connection between the second fixing portion and the power support. The second guiding wheel is mounted to an end of the second rod remote to the power support.

In an example, the connecting rod further includes a buffering module. An end of the buffering module is connected to an end of the first rod opposite to the power support. The other end of the buffering module is connected between two ends of the second rod.

In an example, the buffering module of the connecting rod is a shock absorber, and the buffering module of the driving device is a shock absorber.

In an example, an end of the first rod adjacent to the rod portion includes two lugs, an elongated groove, and a fixing member. A space is defined between the two lugs and receives the rod portion of the power support. The elongated groove extends through the two lugs and extends in a direction parallel to an extending direction of the two lugs. The fixing member is movably mounted in the elongated groove, is movable relative to the connecting rod, and is connected to the rod portion of the power support.

In an example, the wheel assembly further includes a first stopper, a first stabilizing member, a second stopper, and a second stabilizing member. An end of the first stopper is connected to the frame. The other end of the first stopper extends to a location above an upper end of the rod portion and extends downward at a side of the rod portion opposite to the frame. The first stabilizing member is coupled to the frame and is located between the frame and the second rod.

The second stopper is coupled to a side of the first stabilizing member opposite to the frame. The second stopper is mounted to a side of the second rod opposite to the first stabilizing member. The second stabilizing member is coupled to a side of the second stopper adjacent to the connecting rod. The first stabilizing member and the second stabilizing member abut two opposite sides of the second rod, respectively.

In an example, the first stopper is formed by bending a metal plate to form a single piece. The first stabilizing member and the second stabilizing member are made of polyethylene.

In an example, the first fixing portion is adjacent to a front end of the frame. The second fixing portion is adjacent to a rear end of the frame. A height of the first fixing portion in a vertical direction is lower than a height of the second fixing portion in the vertical direction.

The present invention will become clearer in light of the following detailed description of illustrative embodiments of this invention described in connection with the drawings.

DETAILED DESCRIPTION OF THE INVENTION

Figure 1:
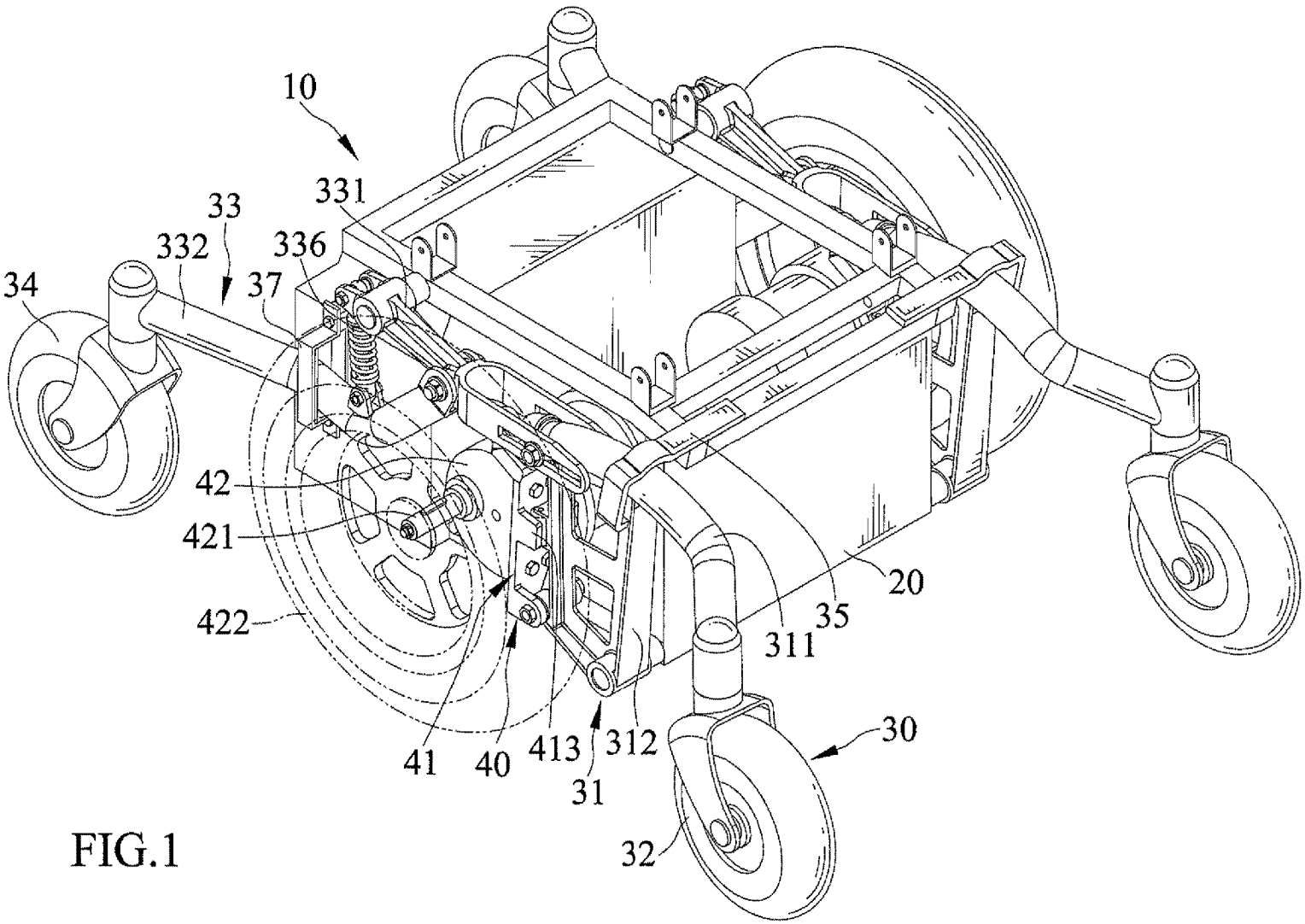
FIG. 1 is a perspective view of an electric wheelchair frame according to the present invention.
Figure 2:
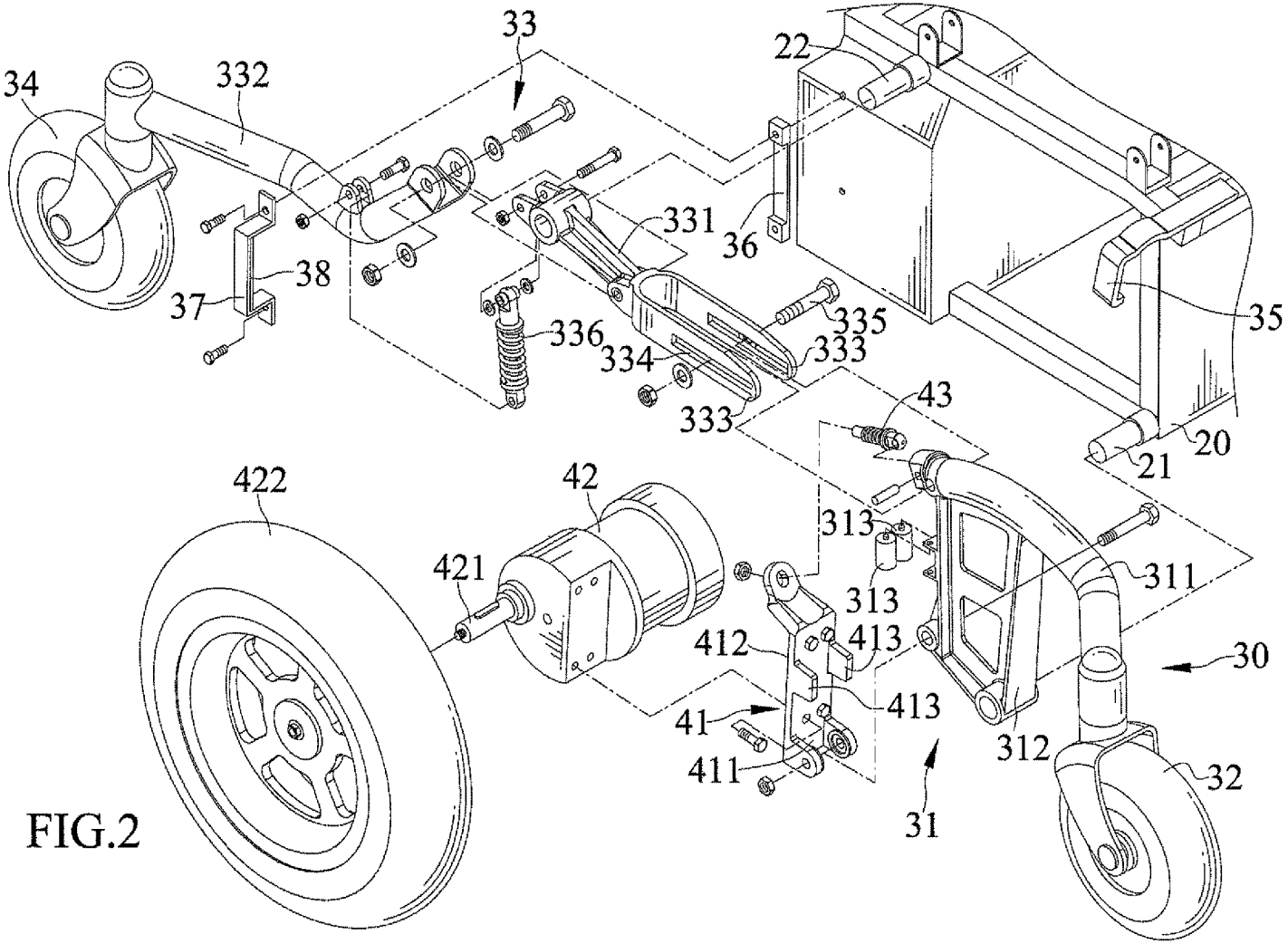
FIG. 2 is an exploded, perspective view of the electric wheelchair frame according the present invention.

With reference to FIGS. 1 and 2, an electric wheelchair frame 10 according to the present invention includes a frame 20, a wheel assembly 30, and a driving device 40. In this embodiment, two electric wheelchair frames 10 are provided for an electric wheelchair.

The frame 20 includes a side having a first fixing portion 21 and a second fixing portion 22 spaced from the first fixing portion 21 in a longitudinal direction. The first fixing portion 21 is adjacent to a front end of the frame 20. The second fixing portion 22 is adjacent to a rear end of the frame 20. A height of the first fixing portion 21 in a vertical direction perpendicular to the longitudinal direction is lower than a height of the second fixing portion 22 in the vertical direction.

The wheel assembly 30 is mounted to the side of the frame 20 and includes a power support 31, a first guiding wheel 32, a connecting rod 33, and a second guiding wheel 34. The power support 31 includes a rod portion 311 and an engaging portion 312. The engaging portion 312 is mounted between two ends of the rod portion 311 and is located at a bottom side of the rod portion 311. The power support 31 is connected to the first fixing portion 21 by an end of the engaging portion 312 remote to the connecting portion 311 and is swayable relative to the frame 20. Two stabilizing rollers 313 are pivotably mounted to a side of the engaging portion 312 about two pivotal axes, respectively. The two pivotal axes of the two stabilizing rollers 313 are parallel to each other. The first guiding wheel 32 is rotatably mounted to an end of the rod portion 311 remote to the frame 20.

The connecting rod 33 includes a first rod 331 and a second rod 332. The connecting rod 33 is connected to the second fixing portion 22 at a location between two ends of the first rod 331 and is swayable relative to the frame 20. One of the two ends of the first rod 331 is pivotably connected to the rod portion 311 and is movable relative to the rod portion 311 in the longitudinal direction. An end of the first rod 331 adjacent to the rod portion 311 includes two lugs 333, an elongated groove 334, and a fixing member 335. A space is defined between the two lugs 333 and receives the rod portion 311 of the power support 31. The elongated groove 334 extends through the two lugs 333 and extends in a direction parallel to an extending direction of the two lugs 333. The fixing member 335 is movably mounted in the elongated groove 334, is movable relative to the connecting rod 33, and is connected to the rod portion 311 of the power support 31.

The second rod 332 is pivotably connected between the two ends of the first rod 331 at a pivotal connection between the second fixing portion 22 and the power support 31. The connecting rod 33 further includes a buffering module 336. An end of the buffering module 336 is connected to an end of the first rod 331 opposite to the power support 31. The other end of the buffering module 336 is connected between two ends of the second rod 332. The buffering module 336 of the connecting rod 33 is a shock absorber in this embodiment. The second guiding wheel 34 is mounted to an end of the second rod 332 remote to the power support 31 and is rotatable relative to the connecting rod 33.

Figure 3:
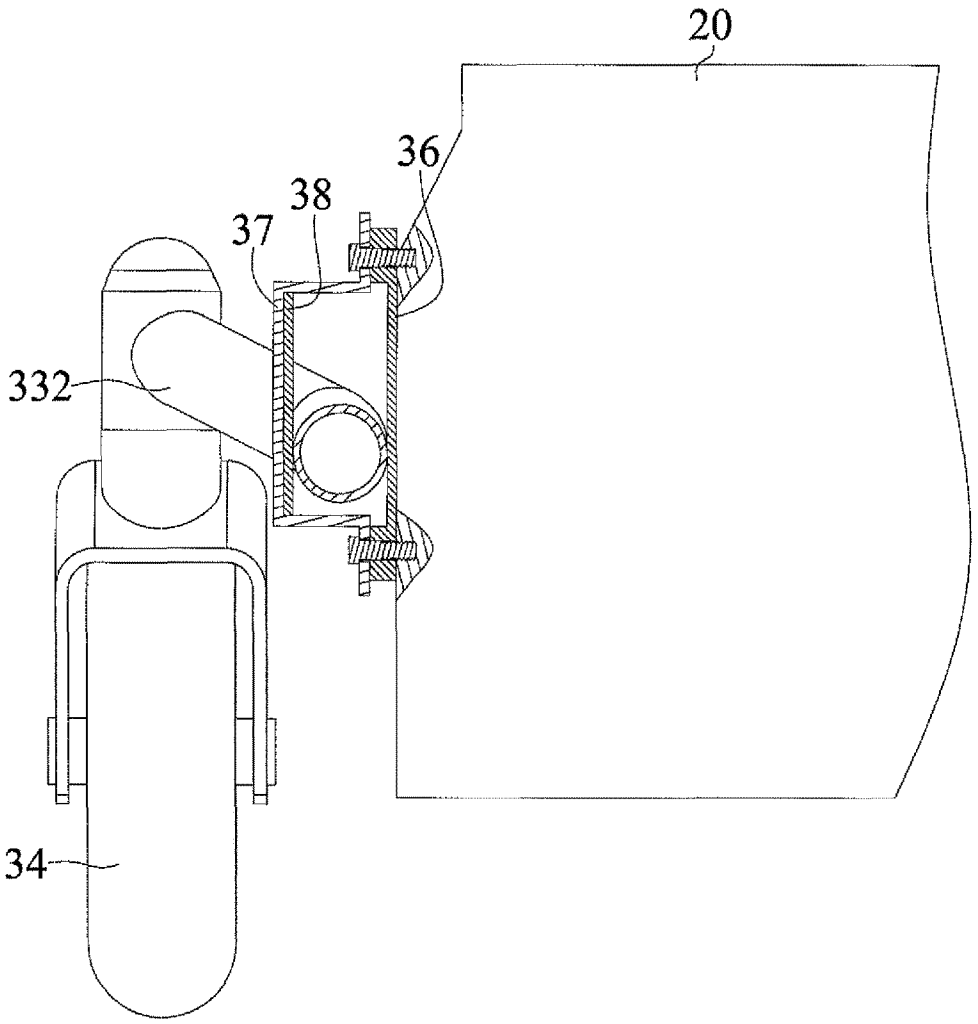
FIG. 3 is a partially cross-sectioned view of a connecting rod portion of the electric wheelchair frame according to the present invention.
Figure 4:
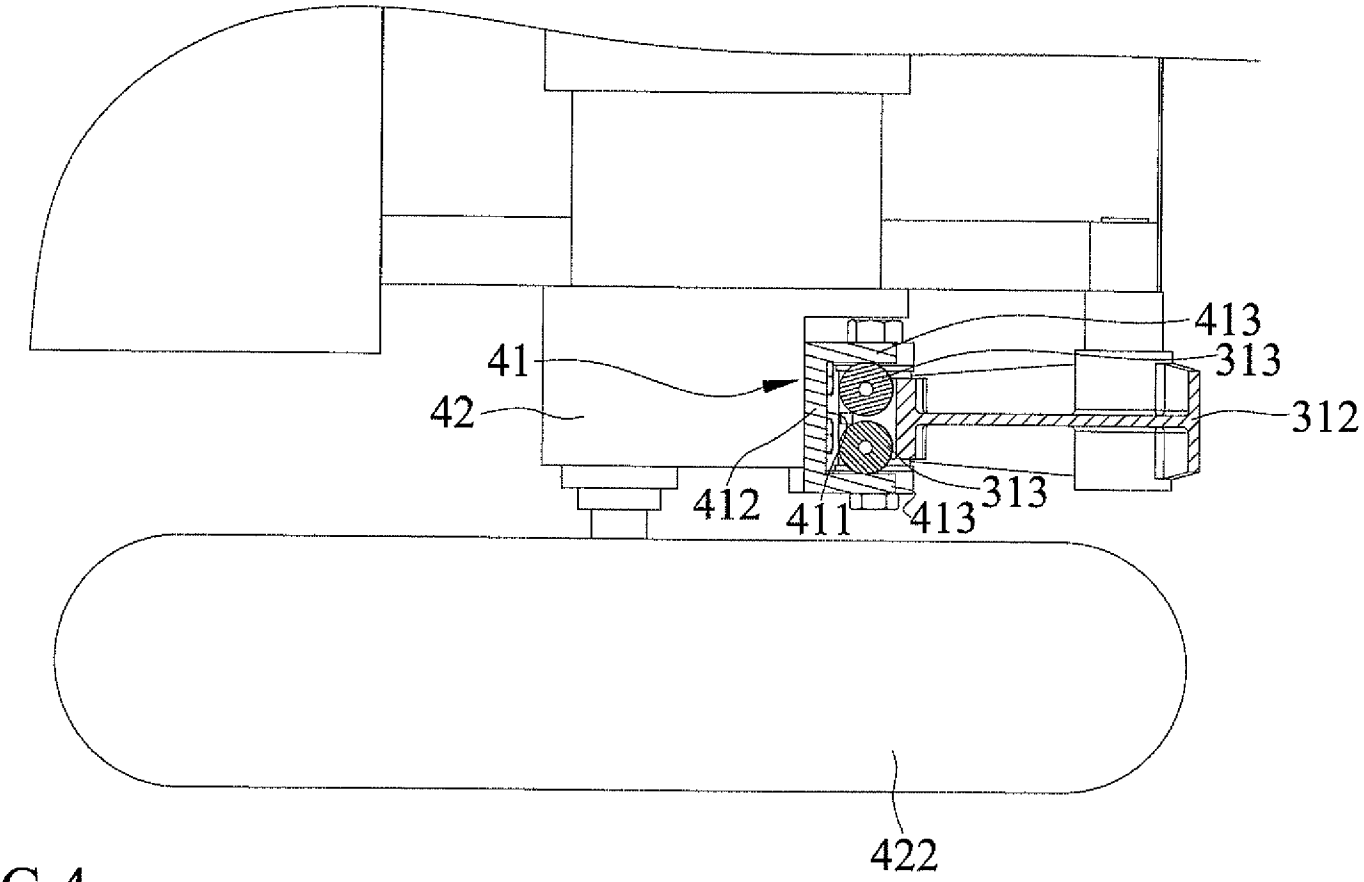
FIG. 4 is a partially cross-sectioned view of a connecting seat portion of the electric wheelchair frame according to the present invention.
Figure 5:
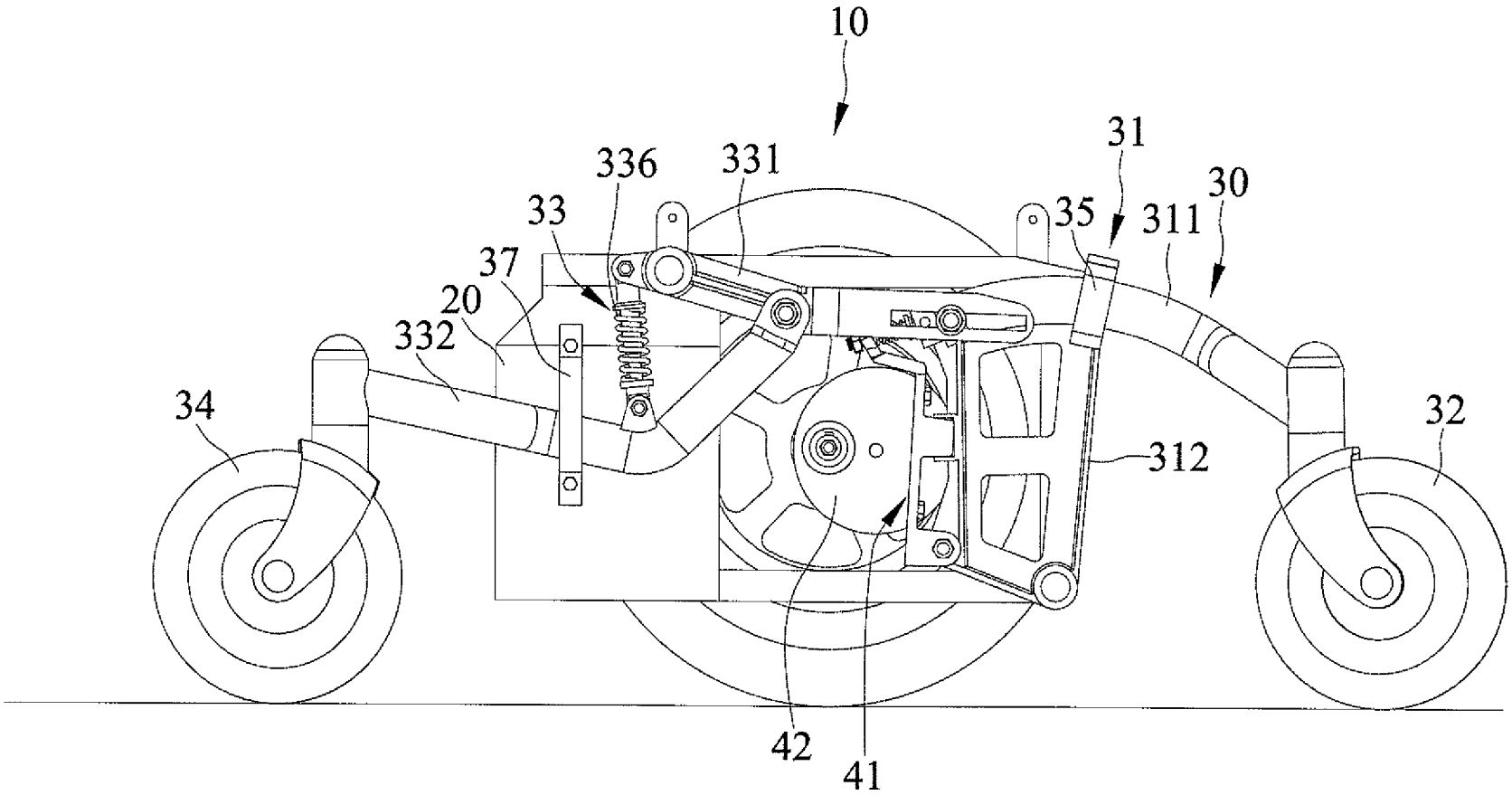
FIG. 5 is a diagrammatic view illustrating use of the electric wheelchair frame according to the present invention on a smooth road.
Figure 6:
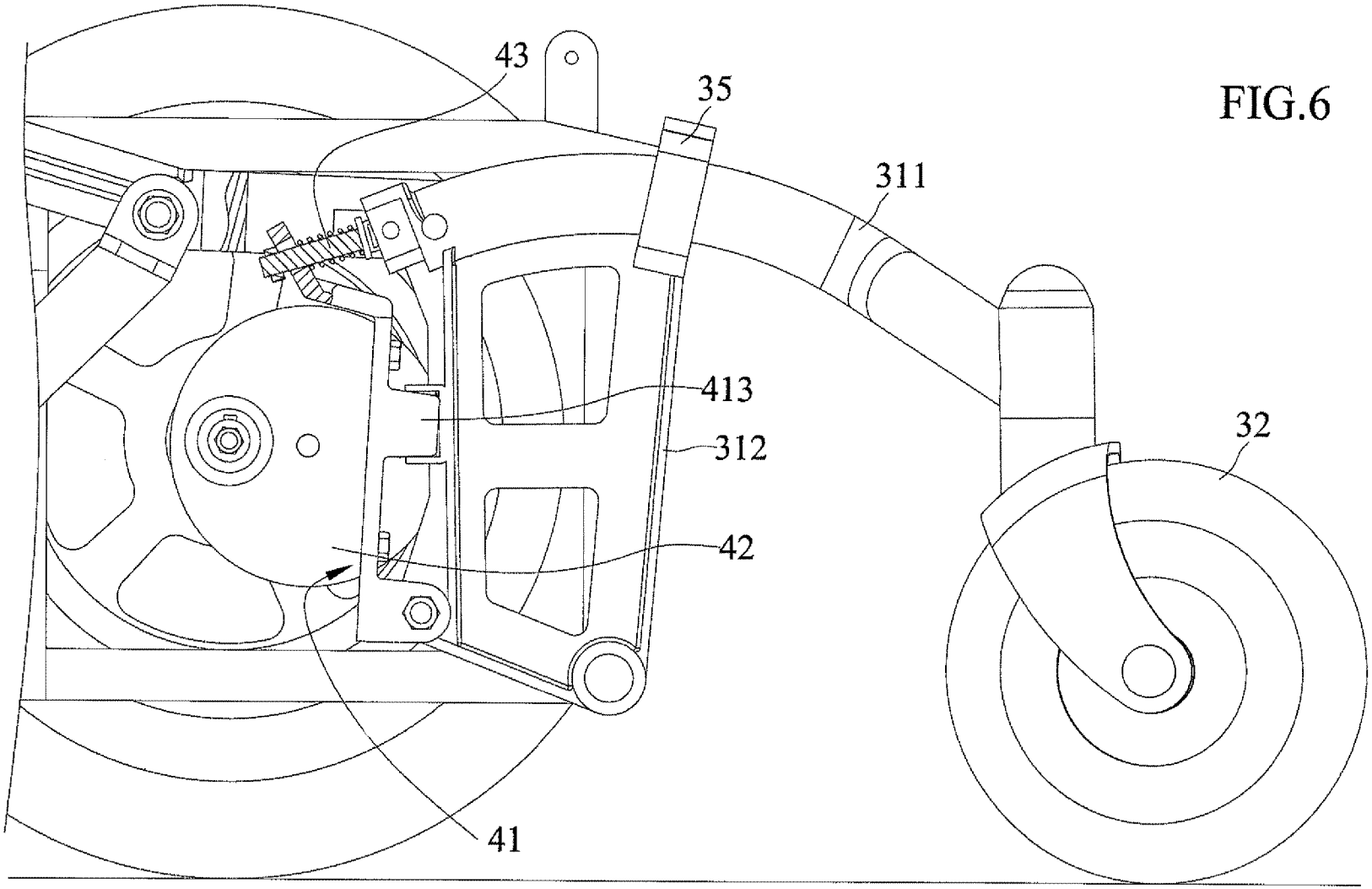
FIG. 6 is an enlarged view of a portion of the electric wheelchair frame of FIG. 5, with the connecting seat not pivoted relative to a power support.
Figure 7:
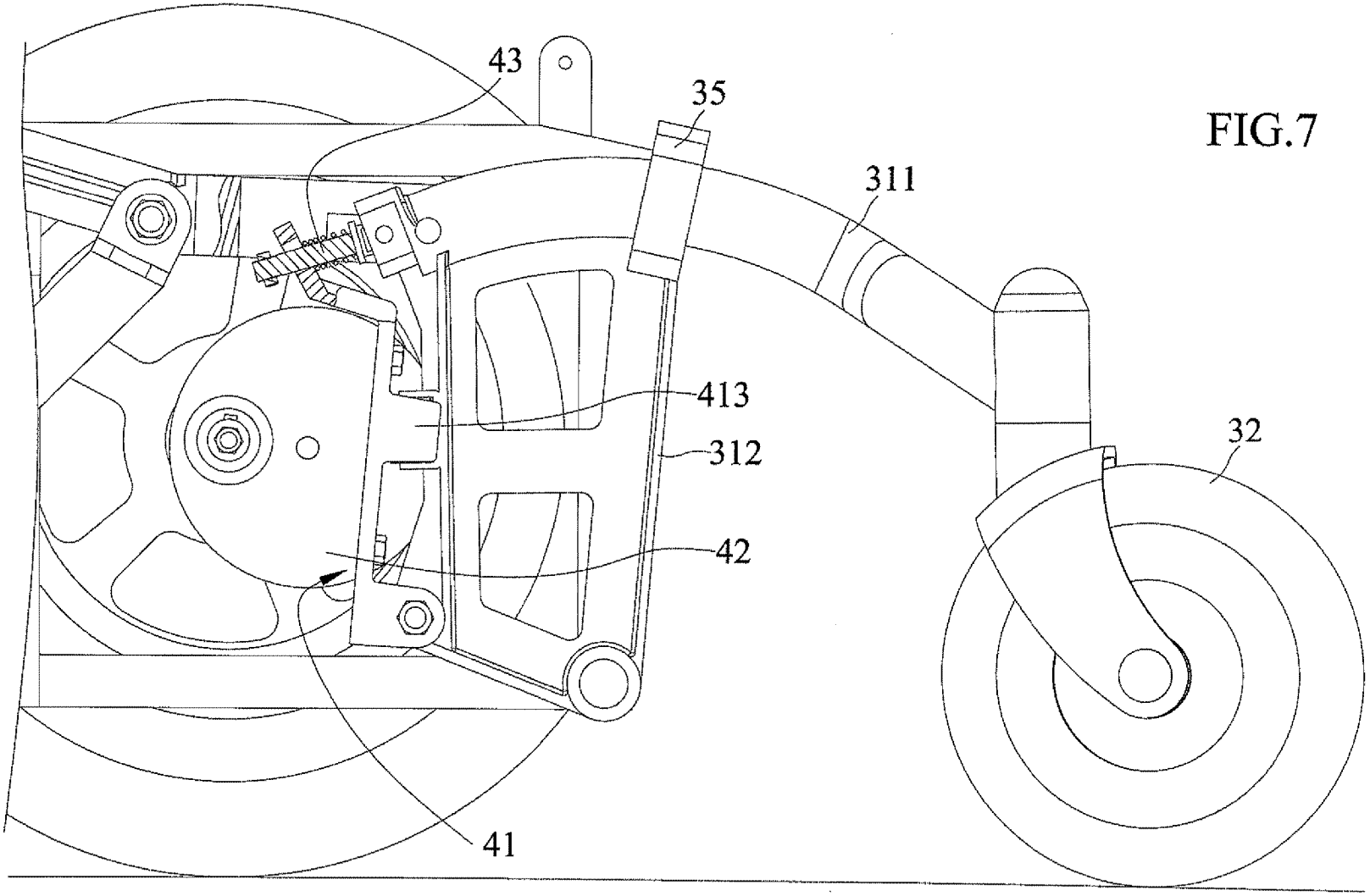
FIG. 7 is a view similar to FIG. 6, with the connecting seat pivoted relative to the power support.
Figure 8:
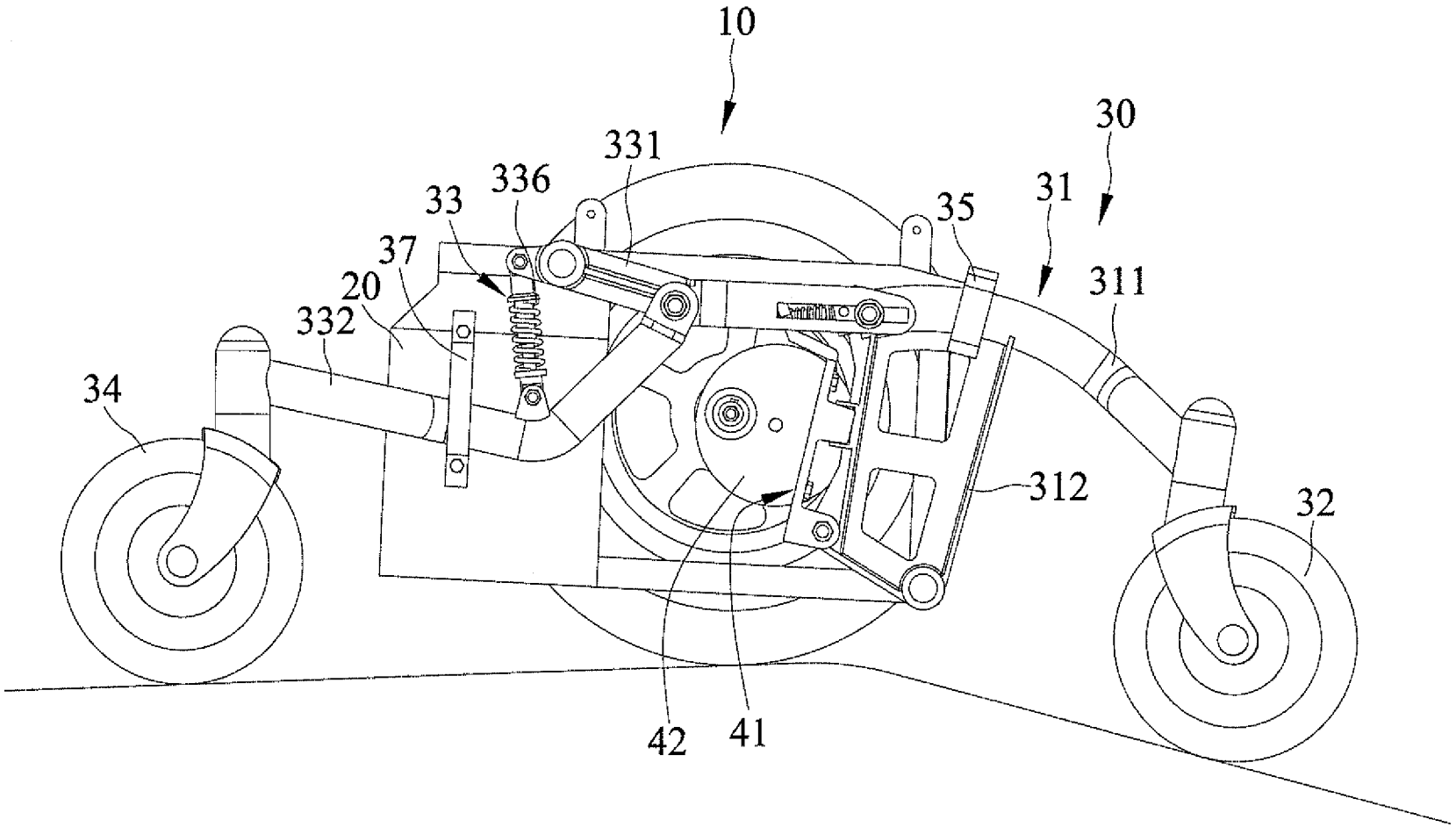
FIG. 8 is a diagrammatic view illustrating use of the electric wheelchair frame on a downhill slope.
Figure 9:
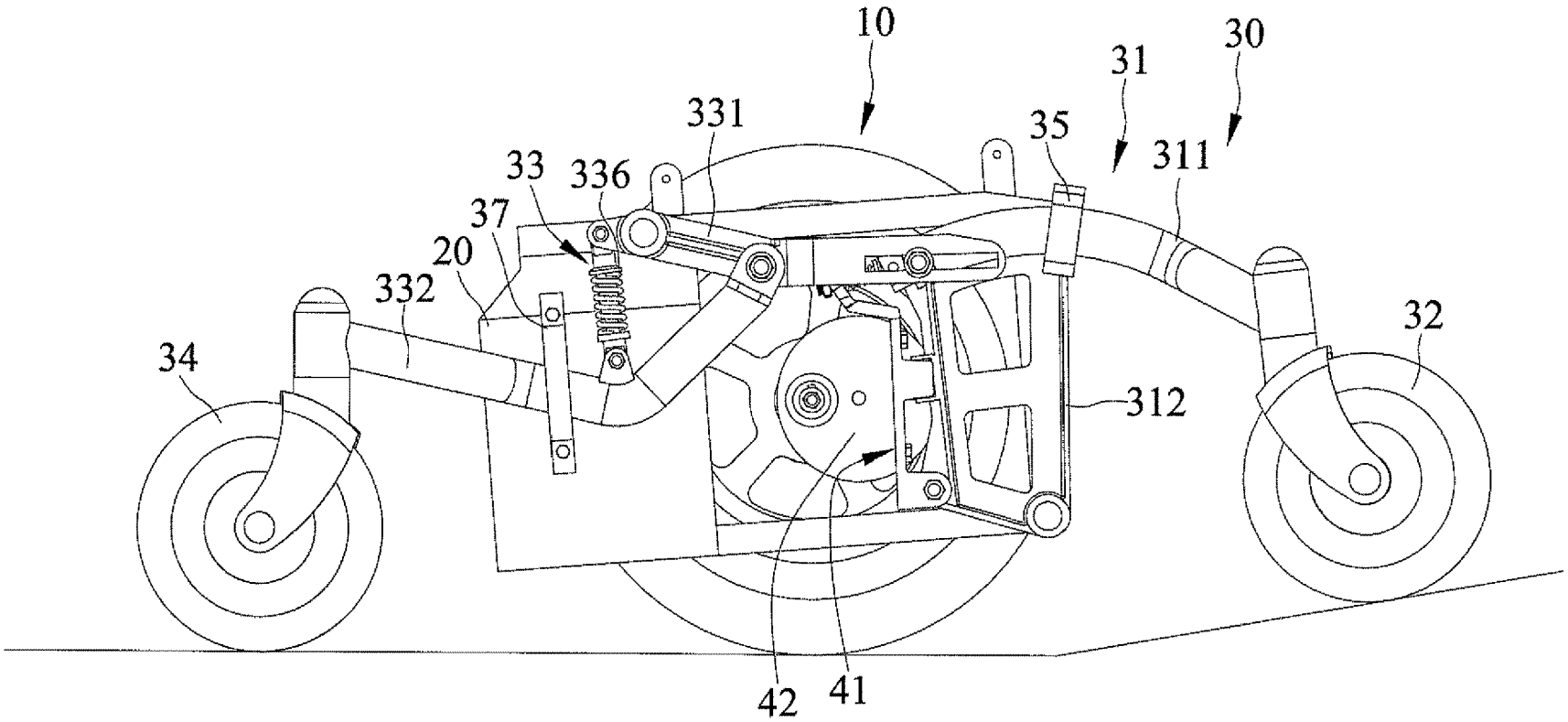
FIG. 9 is a diagrammatic view illustrating use of the electric wheelchair frame on an uphill slope.

With reference to FIGS. 3 and 4, the wheel assembly 30 further includes a first stopper 35, a first stabilizing member 36, a second stopper 37, and a second stabilizing member 38. An end of the first stopper 35 is connected to the frame 20. The other end of the first stopper 35 extends to a location above an upper end of the rod portion 311 and extends downward at a side of the rod portion 311 opposite to the frame 20. The first stopper 35 is formed by bending a metal plate to form a single piece. The first stabilizing member 36 is coupled to the frame 20 and is located between the frame 20 and the second rod 332. The second stopper 37 is coupled to a side of the first stabilizing member 36 opposite to the frame 20. Furthermore, the second stopper 37 is mounted to a side of the second rod 332 opposite to the first stabilizing member 36. The second stabilizing member 38 is coupled to a side of the second stopper 37 adjacent to the connecting rod 33. The first stabilizing member 36 and the second stabilizing member 38 abut two opposite sides of the second rod 332, respectively. The first stabilizing member 36 and the second stabilizing member 38 are made of plastic, such as polyethylene.

The driving device 40 includes a connecting seat 41 and a power output unit 42. The connecting seat 41 includes a first side 411 and a second side 412 opposite to the first side 411. An end of the first side 411 of the connecting seat 41 is pivotably mounted to the engaging portion 312 of the power support 31 about a pivotal axis. Two restraining plates 413 are formed between the first side 411 of the connecting seat 41. The two restraining plates 413 abut two opposite outer sides respectively of the two stabilizing rollers 313. The power output unit 42 is fixed to the second side 412 of the connecting seat 41. The power output unit 42 includes a driving shaft 421 and a driving wheel 422. The driving shaft 421 extends away from the frame 20. A rotating axis of the driving shaft 421 is parallel to the pivotal axis of the connecting seat 41 pivotably connected to the power support 31. The driving wheel 422 is coupled to an end of the driving shaft 421 opposite to the frame 20 and is configured to be driven by the power output unit 42 to rotate relative to the frame 20.

The driving device 40 further includes a buffering module 43. An end of the buffering module 43 of the driving device 40 is connected to the rod portion 311 of the power support 31. The other end of the buffering module 43 of the driving device 40 is connected to an end the connecting seat 41 opposite to a pivotal connection between the connecting seat 41 and the power support 31.

With reference to FIGS. 5-9, due to provision of the first guiding wheel 32, the second guiding wheel 34, and the driving wheel 422, the left and right sides of the electric wheelchair frame 10 contact with the ground to provide a three-point support, increasing the stability of the electric wheelchair frame 10. The power support 31 and the connecting rod 33 can sway relative to the frame 20 independently to assure the first guiding wheel 32, the second guiding wheel 34, and the driving wheel 422 remain in contact with the ground even if the electric wheelchair frame 10 is moving on a bumpy road surface, increasing the terrain adaptability.

The driving device 40 of the electric wheelchair frame 10 is pivotably connected to the power support 31. When the driving wheel 422 is moving on a bumpy road surface, due to the pivotal movement of the connecting seat 41 relative to the power support 31, the impact from the bumpy road surface will not be directly transmitted to the frame 20, and the buffering module 43 of the driving device 40 absorbs the impact. Similarly, when the second guiding wheel 34 is moving on a bumpy road surface, due to pivotal movement of the second rod 332 relative to the first rod 331, the impact from the bumpy road surface will not be directly transmitted to the frame 20, and the buffering module 336 of the connecting rod 33 absorbs the impact. The sitting comfort of a user of the electric wheelchair is, thus, increased.

The first stopper 35 limits the angular position of the rod portion 311 of the power support 31 in the horizontal direction, avoiding leftward/rightward swaying of the rod portion 311. Furthermore, the first stabilizing member 36, the second stopper 36, and the second stabilizing member 38 limits the angular position of the second rod 332 of the connecting rod 33 in the horizontal direction to avoid wobbling of the electric wheelchair frame 10 resulting from leftward/rightward of the power support 31 and the connecting rod 33. Furthermore, the two restraining plates 413 and the two stabilizing rollers 313 limit the position of the connecting seat 41, avoiding leftward/rightward swaying of the connecting seat 41 during pivotal movement of the connecting seat (41), thereby increasing the stability of the electric wheelchair frame 10 during operation.

Although specific embodiments have been illustrated and described, numerous modifications and variations are still possible without departing from the scope of the invention. The scope of the invention is limited by the accompanying claims.

The invention claimed is:

1. An electric wheelchair frame comprising:

a frame including a side having a first fixing portion and a second fixing portion spaced from the first fixing portion in a longitudinal direction;

a wheel assembly mounted to the side of the frame and including a power support, a first guiding wheel, a connecting rod, and a second guiding wheel, wherein the power support is connected to the first fixing portion and is swayable relative to the frame, wherein the first guiding wheel is rotatably mounted to an end of the power support remote to the frame, wherein the connecting rod is connected to the second fixing portion and is swayable relative to the frame, wherein the connecting rod is connected to the power support, is pivotable relative to the power support, and is movable relative to the power support in the longitudinal direction, and wherein the second guiding wheel is rotatably mounted to an end of the connecting rod remote to the power support; and a driving device including a connecting seat and a power output unit, wherein the connecting seat is pivotably mounted to the power support, wherein the power output unit is fixed to the connecting seat and includes a driving shaft and a driving wheel, wherein the driving shaft extends away from the frame, wherein the driving wheel is coupled to an end of the driving shaft opposite to the frame and is configured to be driven by the power output unit to rotate relative to the frame.

2. The electric wheelchair frame as claimed in claim 1, wherein the connecting seat includes a first side and a second side opposite to the first side, wherein an end of the first side of the connecting seat is pivotably mounted to the power support about a pivotal axis, wherein the power output unit is fixed to the second side of the connecting seat, and wherein a rotating axis of the driving shaft is parallel to the pivotal axis of the connecting seat pivotably connected to the power support.

3. The electric wheelchair frame as claimed in claim 2, wherein the power support includes a rod portion and an engaging portion coupled to the rod portion, wherein the connecting seat is pivotably mounted to the engaging portion of the power support, wherein the driving device further includes a buffering module, wherein an end of the buffering module of the driving device is connected to the rod portion of the power support, and wherein another end of the buffering module of the driving device is connected to an end the connecting seat opposite to a pivotal connection between the connecting seat and the power support.

4. The electric wheelchair frame as claimed in claim 3, wherein two stabilizing rollers are pivotably mounted to a side of the engaging portion about two pivotal axes, respectively, wherein the two pivotal axes of the two stabilizing rollers are parallel to each other, wherein two restraining plates are formed between the first side of the connecting seat, and wherein the two restraining plates abut two opposite outer sides respectively of the two stabilizing rollers.

5. The electric wheelchair frame as claimed in claim 3, wherein the engaging portion is mounted between two ends of the rod portion and is located at a bottom side of the rod portion, wherein the power support is connected to the first fixing portion by an end of the engaging portion remote to the connecting portion, wherein the first guiding wheel is mounted to an end of the rod portion remote to the frame, wherein the connecting rod includes a first rod and a second rod, wherein the connecting rod is connected to the second fixing portion at a location between two ends of the first rod, wherein one of the two ends of the first rod is pivotably connected to the rod portion and is movable relative to the rod portion in the longitudinal direction, wherein the second rod is pivotably connected between the two ends of the first rod at a pivotal connection between the second fixing portion and the power support, and wherein the second guiding wheel is mounted to an end of the second rod remote to the power support.

6. The electric wheelchair frame as claimed in claim 5, wherein the connecting rod further includes a buffering module, wherein an end of the buffering module is connected to an end of the first rod opposite to the power support, and wherein another end of the buffering module is connected between two ends of the second rod.

7. The electric wheelchair frame as claimed in claim 6, wherein the buffering module of the connecting rod is a shock absorber, and wherein the buffering module of the driving device is a shock absorber.

8. The electric wheelchair frame as claimed in claim 5, wherein an end of the first rod adjacent to the rod portion includes two lugs, an elongated groove, and a fixing member, wherein a space is defined between the two lugs and receives the rod portion of the power support, wherein the elongated groove extends through the two lugs and extends in a direction parallel to an extending direction of the two lugs, wherein the fixing member is movably mounted in the elongated groove, is movable relative to the connecting rod, and is connected to the rod portion of the power support.

9. The electric wheelchair frame as claimed in claim 5, wherein the wheel assembly further includes a first stopper, a first stabilizing member, a second stopper, and a second stabilizing member, wherein an end of the first stopper is connected to the frame, wherein another end of the first stopper extends to a location above an upper end of the rod portion and extends downward at a side of the rod portion opposite to the frame, wherein the first stabilizing member is coupled to the frame and is located between the frame and the second rod, wherein the second stopper is coupled to a side of the first stabilizing member opposite to the frame, wherein the second stopper is mounted to a side of the second rod opposite to the first stabilizing member, wherein the second stabilizing member is coupled to a side of the second stopper adjacent to the connecting rod, wherein the first stabilizing member and the second stabilizing member abut two opposite sides of the second rod, respectively.

10. The electric wheelchair frame as claimed in claim 9, wherein the first stopper is formed by bending a metal plate to form a single piece, and wherein the first stabilizing member and the second stabilizing member are made of polyethylene.

11. The electric wheelchair frame as claimed in claim 1, wherein the first fixing portion is adjacent to a front end of the frame, wherein the second fixing portion is adjacent to a rear end of the frame, wherein a height of the first fixing portion in a vertical direction is lower than a height of the second fixing portion in the vertical direction.

* * * * *